United States Patent [19]

Kelley

[11] Patent Number: 4,501,370

[45] Date of Patent: Feb. 26, 1985

[54] MEDICINE BOTTLE CLOSURE HAVING AN INDICATOR

[76] Inventor: John A. Kelley, Rte. 2, Box 21C, Lexington, Tenn. 38351

[21] Appl. No.: 307,864

[22] Filed: Aug. 5, 1982

[51] Int. Cl.[3] ..... B65D 55/02

[52] U.S. Cl. ..... 215/219; 215/203; 116/308

[58] Field of Search ..... 215/203, 219, 220; 206/533, 534; 116/308

[56] References Cited

U.S. PATENT DOCUMENTS

| | | | |
|---|---|---|---|
| 2,817,451 | 12/1957 | Giles et al. | 116/308 |
| 3,027,035 | 3/1962 | Farago | 215/219 |
| 3,151,599 | 10/1964 | Livingston | 116/308 |

*Primary Examiner*—George T. Hall
*Attorney, Agent, or Firm*—Pitts and Brittian

[57] ABSTRACT

A top for a pill or other medicine bottle having an externally threaded upper portion which receives the top. The top includes a cover which defines a recess having an internally threaded section for receiving the externally threaded portion of the bottle. The cover is proportioned for closing the upper portion of the bottle. Indicia in the form of numbers from one to twelve in the preferred embodiment are carried by the cover. A dial member rotatably mounted on the cover is moved by the user to indicate the time when the next dosage of medicine contained in the bottle is to be taken. In another embodiment means are provided to child proof the top such that children cannot inadvertently gain access to the bottle contents.

5 Claims, 3 Drawing Figures

MEDICINE BOTTLE CLOSURE HAVING AN INDICATOR

DESCRIPTION

1. Technical Field

This invention relates to medicine bottles and more particularly concerns bottles used to dispense dosages of medicines at preselected times. In this particular invention, a top is provided which includes means to indicate the time at which the next dosage is to be taken.

2. Background Art

There are various types of tops for medicine bottles presently available on the market. These tops in certain cases are designed to assist in preventing children from inadvertently gaining access to the medicine and ingesting such medicine resulting in bodily harm. In this regard, the tops are removed from the medicine bottle by methods which normally incorporate a step which will deceive the child and thereby prevent him from removing the top.

A common problem with dispensing dosages of medicine is forgetting the time at which the last dosage was taken or the time at which the next dosage needs to be taken. Since it is desirable that the medicine bottle itself incorporate means for indicating the time at which the next dosage is to be dispensed, it is an object of the present invention to provide an improved medicine bottle top which includes a dial type indicator readily adjustable by the user for indicating time. Another object of the present invention is to provide an improved medicine bottle top which can be readily and inexpensively manufactured. Yet another object of the present invention is to provide an improved medicine bottle top which incorporates features that assist in preventing a child from inadvertently gaining access to medicine contained within the bottle. Other objects and advantages of the device will become apparent upon reading the detailed description together with the drawings described as follows.

DISCLOSURE OF THE INVENTION

In accordance with various features of the invention, an improved top for a pill or other medicine bottle having an externally threaded upper portion designed for receiving a top is provided. The top includes a cover member which defines a recess having an internally threaded section for threadably receiving the externally threaded portion of the bottle. This cover is proportioned for closing the upper portion of the bottle and carries indicia representative of time. A dial member is mounted on the cover means and includes an indicator which is moved by the user to a location corresponding with the time at which the next dosage of medicine contained within the bottle is to be ingested. In one embodiment, the indicia comprises raised numbers from one to twelve substantially equally spaced around said first member of said cover. The numbers serve to indicate the time for the medicine to be taken. In another embodiment, the top having the time indicator is combined with means to assist in preventing a child from inadvertently gaining access to the bottle contents.

BEST MODE FOR CARRYING OUT THE INVENTION

Figure 1:
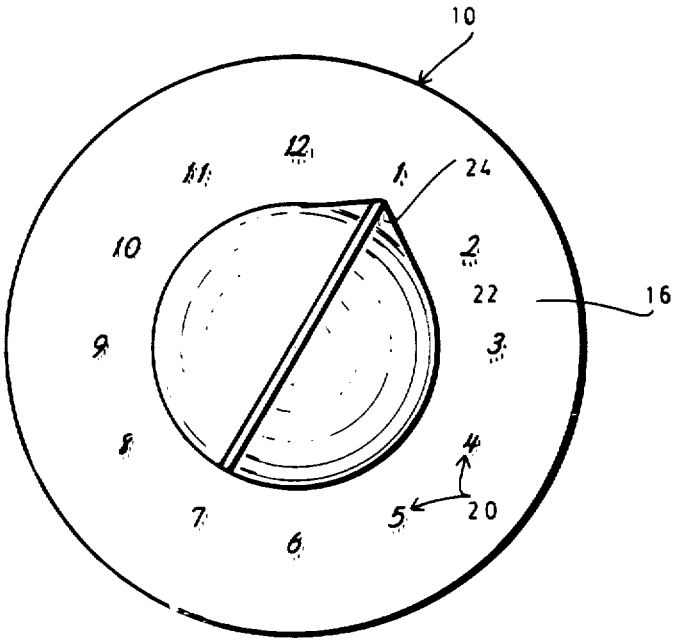
FIG. 1 is a plan view of the upper portion of an improved medicine bottle top constructed in accordance with various features of the invention.

Referring now to the drawings, an improved top for a medicine bottle constructed in accordance with various features of the invention is generally indicated at 10 in FIG. 1. This top includes a cover 12 which defines a recess 14 having an internally threaded section designed for threadably receiving the externally threaded portion of the medicine bottle which is to be covered and secured by the top. It will, of course, be recognized that the type and pitch of the threads defined by the cover will be designed to mesh with the threads defined in the upper portion of the bottle.

Figure 2:
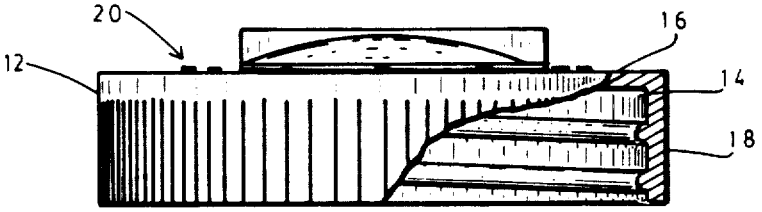
FIG. 2 is an elevation view of a top similar to the illustration in FIG. 1 with a portion of the depending section of the top broken away to illustrate further features of the invention.

The cover is proportioned for closing the upper portion of the bottle and in the embodiments illustrated in FIGS. 1 and 2, the cover includes a first member having a first section 16 which is substantially circular in cross-sectional outline. This section 16 defines an upper surface which is substantially planar and includes a perimeter having a circular outline. The cover includes a further section generally indicated at 18 which is carried by the perimeter of the first section 16 and depends therefrom. More specifically, the upper portion of the section 18 is integrally formed with the perimeter of the section 16 in the preferred embodiment. This section 18 includes an internally threaded portion which receives the externally threaded portion of the upper portion of the bottle for purposes of mounting the top on the bottle to cover and secure medicine.

Means are provided to indicate the time for purposes of providing ready notice to the user of the upcoming time for the next dosage. In the illustrated embodiment, indicia means generally indicated at 20 are provided. In FIGS. 1 and 2, the indicia means includes a plurality of raised numbers from one to twelve which are substantially equally spaced around the upper surface of the member 16.

Figure 3:
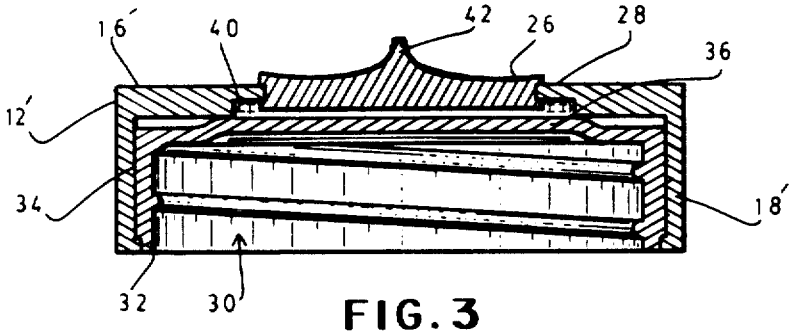
FIG. 3 is a sectional side elevation view of a top which includes a first member and a further member rotatably mounted with respect to each other and which are frictionally joined by squeezing a portion of the first member to assist in preventing children from inadvertently gaining access to the contents of the bottle. This top also includes a dial member having a raised tab to assist in allowing rotation of the dial member for purposes of indicating the time at which the next dosage is to be taken.

These numbers are used to indicate the time at which the next medicinal dosage is to be dispensed and in this connection a dial member generally indicated at 22 is provided. This dial member is mounted on the cover such that it can be rotated for purposes of aligning the indicator 24 with a number corresponding with the time for the next dosage. As shown in FIG. 1, the dial member is substantially circular in cross-sectional outline and includes the indicator 24 which is integrally formed with the dial member and serves as an arrow for purposes of pointing to a preselected number carried by the cover. This dial member is rotatably mounted on the cover or more specifically the first section of the cover, and as illustrated in FIG. 3 the perimeter 26 of the dial member is provided with an annular recess which receives the circular mouth 28 of the first section of the cover which defines the opening within which the dial member fits. This dial member can be mounted within the opening defined in the first member of the cover by snapping it into position, and in this regard the cover and the dial member are normally fabricated from a semi-rigid material which will flex for purposes of mounting the dial member.

In the embodiment illustrated in FIG. 3, the cover 12' includes first member having a section 16' which is substantially circular in cross-sectional outline and more specifically described hereinabove. A further section indicated at 18' defines a depending portion which is fabricated from a material that flexes when it is squeezed for purposes that will be more clearly understood hereinafter A further member generally indicated at 30 is rotatably mounted within the first member and includes an internal surface which is internally threaded for purposes of threadably receiving the externally threaded upper portion of the bottle. This further member 30 is mounted within the first member of the cover 12' by means of the detent 32 which rotatably secures the further member within the first member. For assemblying purposes, the further member is proportioned such that it slides or is telescoped into one recess defined by the first number, and snaps into position as the detent generally indicated at 32 and corresponding recess mate. In order to open the top in the embodiment constructed in accordance with FIG. 3, the depending section 18' of the cover is squeezed until it frictionally engages the external surface 34 of the further member 30 and as it is squeezed and rotated, the threads in the further member are threadably advanced off of the upper portion of the bottle. It will, of course, be recognized that other forms of child proofing can be used as necessary or desired.

As illustrated in FIG. 3, the further member 30 includes an upper section 36 which closes the upper portion of the bottle to prevent the escape of the medicine. This upper section 36 includes an offset section as illustrated which is designed to close the lower portion of the opening defined by the rim or mouth 28 of the cover proximate said opening. This assists in preventing the dial member 22 from moving through the opening, and in certain embodiments will provide a support for the lower surface of the dial as when the perimeter of the dial is fabricated with a flange 40. The phantom lines depicting the flange 40 in FIG. 3 eliminates the provision of the annular recess provided in the dial perimeter. In this embodiment, the flange will simply be flexed into the position illustrated in FIG. 3 and the movement of the dial completely through the opening defined by the mouth 28 is prevented by the upper section 36 of the further member 30 which serves as a stop. The flange 40 assists in preventing vertical movement of the dial thereby rotatably securing the dial.

In the embodiment illustrated in FIG. 3, the dial member includes a raised central tab 42 which facilitates gripping the dial for purposes of rotating the dial until the indicator 24 is positioned at the preselected location depicting the time for the next dosage. It will, of course, be recognized that the various embodiments of the dial can be constructed for purposes of indicating dosage times.

From the forgoing detail description of the drawings, it will be recognized that an improved top for a medicine bottle has been illustrated and described. The preferred top includes a dial member which can be rotated for purposes of indicating the time at which medicine contained within the bottle is to be dispensed. This dial and indicator are incorporated within the top and can readily be moved or actuated by the user. In accordance with another feature of the invention, a child proofing arrangement is provided which assists in preventing a child from inadvertently gaining access to the contents of the bottle.

While a preferred embodiment has been shown and described, it will be understood that there is no intent to limit the invention by such disclosure, but rather, it is intended to cover all modifications and all constructions following within the spirit and scope of the invention as defined in the appended claims.

I claim:

1. A top for a pill or other medicine bottle to indicate to a user the time for a next dose, said bottle having an externally threaded upper portion which receives the top, said top comprising:

cover means for closing the upper portion of said bottle upon being mounted thereon, said cover means comprising a first member having a first section which is substantially circular in cross section and defines an upper surface, and a further section which is carried by the perimeter of said first section and depends therefrom, said further section including an internally threaded portion which receives the externally threaded portion of said upper portion of said bottle, said first member of said cover means defining an opening including a mouth which circumscribes said opening;

a plurality of indicia provided on said upper surface of said first member serving to indicate time at which the next dosage of medicine contained within said bottle is to be taken; and a dial member including an annular perimeter which defines a recess that receives said mouth of said first member whereby said dial member is rotatably mounted in said opening in said first member, said dial member having an indicator which is moved by the user to be aligned with one of said indicia to indicate the time when the next dosage of medicine contained in said bottle is to be taken.

2. The top of claim 1 wherein said indicia means are raised in elevation relative to said upper surface of said first member.

3. The top of claim 1 wherein said indicia comprise raised numbers from 1 to 12, inclusive, substantially equally spaced around said first member, said numbers serving to indicate the time at which the next dosage of medicine contained within said bottle is to be taken.

4. The top of claim 1 wherein said dial member includes a raised central tab which facilitates gripping said dial member for rotational purposes.

5. A top for a pill or other medicine bottle, said bottle having an externally threaded upper portion which receives the top, said top comprising:

cover means including a first member having a first section which is substantially circular in cross-sectional outline and defining an upper surface, and a further section having a depending portion which flexes when squeezed, and a further member which is rotatably mounted within said first member and includes an internal surface which is externally threaded for purposes of receiving the externally threaded upper portion of said bottle, said further member being rotated for purposes of opening said bottle by squeezing said flexible depending portion of said first member such that said first member and further member frictionally engage, said first section of said first member defining an opening including a mouth which circumscribes said opening;

a plurality of indicia provided on said upper surface of said first member serving to indicate the time at which the next dosage of medicine contained within said bottle is to be taken; and A dial member including an annular perimeter which defines a recess that receives said mouth of said first member whereby said dial member is rotatably mounted in said opening in said first member, said dial member having an indicator which is moved by the user to be aligned with one of said indicia to indicate the time when the next dosage of medicine contained in said bottle is to be taken.

* * * * *